United States Patent [19]

Winton et al.

[11] 4,246,845

[45] Jan. 27, 1981

[54] AC INITIATION SYSTEM

[75] Inventors: Murray T. Winton, Arnold; Dale L. Beezley; Kwok S. Chan, both of Sunnyvale, all of Calif.

[73] Assignee: The United States of America as represented by the Secretary of the Navy, Washington, D.C.

[21] Appl. No.: 972,538

[22] Filed: Dec. 22, 1978

[51] Int. Cl.[3] ..... F42C 11/00

[52] U.S. Cl. ..... 102/206

[58] Field of Search ..... 102/206, 215, 218; 361/248

[56] References Cited

U.S. PATENT DOCUMENTS

| | | | |
|---|---|---|---|
| 3,288,068 | 11/1966 | Jefferson et al. | 102/218 |
| 3,293,527 | 12/1966 | Julich | 102/218 |
| 3,329,092 | 7/1967 | Bassie | 102/218 |
| 3,439,616 | 4/1969 | Godsey et al. | 102/220 |
| 3,719,149 | 3/1973 | Masin | 102/213 |
| 3,888,181 | 6/1975 | Kups | 102/206 |
| 3,924,535 | 12/1975 | Roos et al. | 102/215 |
| 3,967,554 | 7/1976 | Troyer, Jr. | 102/215 |
| 4,068,556 | 1/1978 | Foley | 102/218 |

*Primary Examiner*—Charles T. Jordan

*Attorney, Agent, or Firm*—R. S. Sciascia; Charles D. B. Curry; Fracis I. Gray

[57] ABSTRACT

An ac initiation system which uses three ac transmission signals interlocked for safety by frequency, phase and power discrimination. The ac initiation system is prearmed by the application of two ac signals having the proper phases, and activates a load when an ac power signal of the proper frequency and power level is applied.

5 Claims, 1 Drawing Figure

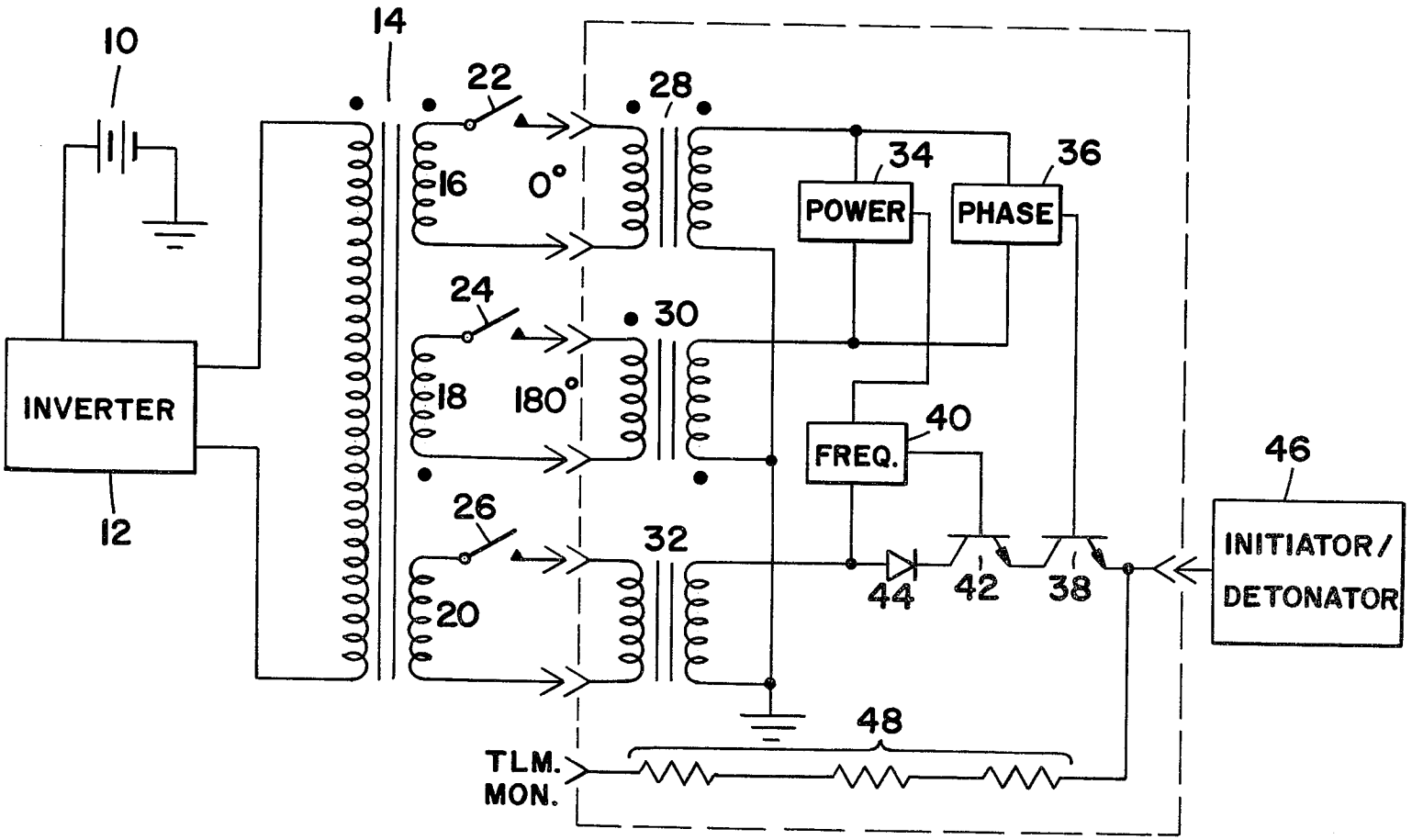
INITIATOR/
DETONATOR
46
PHASE
36
POWER
34
FREQ.
40
38
42
44
48
28
30
32
0°
180°
22
24
26
16
18
20
14
10
INVERTER
12
TLM.
MON.

AC INITIATION SYSTEM

BACKGROUND OF THE INVENTION

1. Field of the Invention

The present invention relates to initiation systems, and more particularly to an ac initiation system using three ac transmission signals interlocked for safety by frequency, phase and power discrimination.

2. Description of the Prior Art

The use of electroexplosive devices (EEDs) for initiation and control of missile systems is limited to only two acceptable techniques. One is the low-voltage hot-wire primary ordnance EED initiator incorporating an electromechanical safe and arm (S&A) device. The other is a high-voltage exploding bridgewire (EBW) secondary-ordnance EED initiator incorporating a safety spark-gap device. Both of these systems require parallel redundant channels to achieve advanced missile reliability requirements. This tends to increase missile volume, weight, and cost.

The hot-wire EED system uses primary ordnance and, therefore, requires inclusion of an S&A device. The electromechanical S&A device maintains the EED out of alignment for safing and moves the EED inline with the ordnance event for arming. The S&A requires EED mechanical movement and retention in all operational environments, and places limits on the reliability per initiation channel and on the weight and volume. The hot-wire EEDs have demonstrated high reliability; however, because of electrical power source limitations, an EED high-order output requires the use of primary ordnance.

The high-voltage EBW secondary-ordnance EED represents an attempt to eliminate the limiting effects of low-voltage primary ordnance and the S&A device used in the initiation and control of missile systems. The higher voltage power source permits secondary-ordnance initiation, thus eliminating the need for an S&A device. The high-voltage EED system includes a hold-off spark gap, and achieves a reliability higher than that of the low-voltage system. However, special packaging techniques are required to preclude arcing at high altitude, and, for complex systems, the spark gap reliability requires redundancy, which affects volume. The high-voltage EBW system also has difficulty in satisfying vulnerability and hardening concerns.

Therefore, it is desired to provide sufficient electrical power for hot-wire secondary high-order ordnance EEDs with such a high reliability that redundancy is not necessary.

SUMMARY OF THE INVENTION

Accordingly, the present invention provides an ac initiation system which uses three ac transmission signals interlocked for safety by frequency, phase and power discrimination. Two ac signals are applied to pre-arm the ac initiation system by determining proper phase. The proper frequency of the ac initiation command completes the arming of the ac initiation system and the ac power of the initiation command determines whether a load is activated.

Therefore, it is an object of the present invention to provide an ac initiation system.

Another object of the present invention is to provide an ac initiation system which eliminates the need for redundancy with concomitant weight and volume savings without impairing reliability.

Other objects, advantages and novel features will be apparent from the following detailed description when read in view of the appended claims and attached drawing.

BRIEF DESCRIPTION OF THE DRAWING

The FIGURE is a schematic diagram of an ac initiation system according to the present invention.

DESCRIPTION OF THE PREFERRED EMBODIMENT

Referring now to the FIGURE a battery 10, such as is commonly found on aerospace vehicles, provides power to an inverter 12. The inverter 12 converts the dc battery power to ac power using standard techniques. A transformer 14 converts the ac power from the inverter 12 into three ac transmission signals having predetermined voltage levels. The first secondary 16 of the transformer 14, for instance, produces an ac transmission signal having a 0° phase; and the second secondary 18 produces an ac transmission signal having a 180° phase with respect to the primary 14. The phase of the third ac transmission signal at the third secondary 20 is not important for this embodiment, but it could be used, if desired, in conjunction with the phases of the first and second ac transmission signals for additional phase discrimination. Each secondary 16, 18, 20 is controlled by command, indicated as switches 22, 24, 26, which may be any switching device, preferably solid state, known to the art.

The three ac transmission signals are input to three transformers 28, 30, 32. The first two transformers 28, 30 transform the first two ac transmission signals such that one signal is reversed in phase, i.e., from 180° phase to 0° phase for the second ac transmission signal. If either or both ac transmissions signals are present at the secondaries of transformers 28, 30, a power converter 34 provides a dc power output. If the phases of both ac transmission signals at the secondaries of transformers 28, 30 are identical, a phase comparator 36 provides an output to turn on a first power transistor 38. The third ac transmission signal is stepped down in voltage by the third transformer 32. A frequency detector 40, powered by the dc power from the power converter 34, provides an output to turn on a second power transistor 42 in series with the first power transistor 38. The stepped down third ac transmission signal is rectified, such as by a diode 44, to provide the dc power for the power transistors 38, 42. If the dc power from the rectified ac transmission signal is sufficient, a load 46, such as a low voltage non-primary initiator/detonator, will be activated. A series of resistors 48 provide a monitor point for the output voltage of the last power transistor 38, i.e., the input voltage to the load 46. Thus, the coincidental presence of two ac signals having the proper phase with a third ac signal having the correct frequency and power level results in activation of the load 46.

The phase comparator 36 and the frequency detector 40 are standard circuits well known in the art. The three transformers 28, 30, 32 are preferably toroidal to permit the windings to be physically separated for immunity to dc inputs. The load 46 for ordnance ignition applications may be any initiator/detonator of the low voltage type, such as deflagration types or high order types, or an exploding bridgewire (EBW) type if the third transformer 32 is a high voltage step-up with a charging capacitor and a spark gap switch.

Since ac transmission is involved, the circuit of the present invention may be used for other applications besides ordnance ignition. Wherever remote application of power is desired with an anti-sabotage or a safety interlock, either for explosive detonation, valve actuation or the like, this circuit may be used since transformers may be used as in regular power transmission to step up or down the ac voltages to compensate for line losses and provide the necessary output voltages. For example, remote shutdown of an atomic pile or actuation of an underwater valve on an oil well head to stop an oil leak are distinct possibilities as uses for this initiation system.

Thus, the present invention provides a solid state ac initiation system for ordnance or other uses which has a phase, frequency and power interlock to assure safe and reliable activation of a load without the need for redundant units, electromechanical devices or long ordnance chains with resultant cost and weight savings.

What is claimed is:

1. An ac initiation system comprising:
(a) means for determining the phases of a first and a second ac transmission signal;
(b) means for determining the frequency of a third ac transmission signal; and
(c) means for generating an initiation signal to a load when the phases of said first and second ac transmission signals, the frequency of said third ac transmission signal and the power level of said third ac transmission signal have predetermined values.

2. An ac initiation system as recited in claim 1 wherein said phase determining means comprises:
(a) a first transformer to which said first ac transmission signal is input;
(b) a second transformer to which said second ac transmission signal is input, said first and second transformers being configured such that the output ac signals have the same phase when said first and second ac transmission signals have the predetermined phase values; and
(c) a phase comparator to which the output ac signals from said first and second transformers are input to provide an output signal when the phases of the output ac signals are the same.

3. An ac initiation system as recited in claim 1 wherein said frequency determining means comprises:
(a) a frequency detector to which said third ac transmission signal is input such that when said third ac transmission signal has the predetermined frequency value an output signal is provided; and
(b) means for enabling said frequency detector when said first and second ac transmission signals are present.

4. An ac initiation system as recited in claim 3 wherein said enabling means comprises a power converter which converts the outputs of said first and second transformers to a dc power level which provides power for said frequency detector when said first and second ac transmission signals are present.

5. An ac initiation system as recited in claim 1 wherein said generating means comprises:
(a) a third transformer to which said third ac transmission signal is input, said third transformer stepping the voltage of said third ac transmission signal to a value sufficient to activate said load when said third ac transmission signal has the predetermined power value;
(b) a first switch which is activated by the output signal of said phase comparator; and
(c) a second switch which is activated by the output signal of said frequency detector, said first and second switches being in series between the output of said third transformer and said load.

* * * * *